US006324515B1

(12) United States Patent
Rabipour et al.

(10) Patent No.: US 6,324,515 B1
(45) Date of Patent: Nov. 27, 2001

(54) METHOD AND APPARATUS FOR ASYMMETRIC COMMUNICATION OF COMPRESSED SPEECH

(75) Inventors: Rafi Rabipour, Cote St. Luc; Paul Coverdale, Nepean, both of (CA); William Navarro, Velizy-Villacoublay (FR)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/088,895

(22) Filed: Jun. 2, 1998

(51) Int. Cl.[7] ..... G10L 21/04
(52) U.S. Cl. ..... 704/500; 704/201
(58) Field of Search ..... 704/200, 201, 704/500, 501; 455/550, 500, 561

(56) References Cited

U.S. PATENT DOCUMENTS

| | | | | |
|---|---|---|---|---|
| 5,182,746 | * | 1/1993 | Hurlbut et al. | 370/100.1 |
| 5,455,579 | * | 10/1995 | Bennett el al. | 341/110 |
| 5,479,445 | * | 12/1995 | Klokler et al. | 375/220 |
| 5,742,910 | * | 4/1998 | Gallant et al. | 455/550 |
| 5,799,091 | * | 8/1998 | Lodenius | 380/49 |
| 6,078,809 | * | 6/2000 | Proctor | 455/416 |

FOREIGN PATENT DOCUMENTS

| | | | |
|---|---|---|---|
| PCT/CA95/00704 | 12/1995 | (CA) . | |
| 9163309 A | * 6/1997 | (JP) | H04N/5/93 |

* cited by examiner

*Primary Examiner*—Richemond Dorvil
(74) *Attorney, Agent, or Firm*—Dennis R. Haszko; Smart & Biggar

(57) ABSTRACT

This invention relates to a method and an apparatus for processing digital audio signals that may reduce the signal degradation occurring when the signal is exchanged between two communication terminals equipped with vocoders in a communication network. The solution proposed by this invention is to provide a communication terminal with a vocoder including a decoder section provided with a plurality of decoding units. A switch activates a selected one of the decoding units in dependence of the format of the compressed audio signal data frames received from a remote communication terminal. This system allows the communication terminal to support a number of different speech compression formals. In order to achieve simplicity and low cost, the communication terminal is provided with a single encoding unit. This results in an asymmetric arrangement where the communication terminal has a large number of decoding units than encoding units. The great majority of the speech compression algorithms deployed in wireless and Internet telephony standards have the property that their speech decoders are of far less computational complexity than their respective speech encoder. Therefore, a low-cost terminal can be produced which supports a low complexity speech encoder unit and a variety of speech decoder units.

12 Claims, 6 Drawing Sheets

(1 OF 2)

(2 OF 2)

METHOD AND APPARATUS FOR ASYMMETRIC COMMUNICATION OF COMPRESSED SPEECH

FIELD OF THE INVENTION

This invention relates to a method and an apparatus for processing digitized voice signals in a communications environment that can be of a wireless nature.

BACKGROUND OF THE INVENTION

In recent years, the telecommunications industry has witnessed the proliferation of a variety of digital vocoders in order to meet bandwidth demands of different wireline, and wireless communication systems. The name "vocoder" stems from the fact that its applications are specific to the encoding and decoding of voice signals primarily. Vocoders are usually integrated in mobile telephones and in base stations of the communication network. They are also found on computer sound cards and used for Internet telephony. They provide high compression of a digitized voice signal as well as the reverse transformation while maintaining acceptable speech quality.

For the purposes of this specification, the term "vocoder" is defined as a speech coding device that includes two main sections, namely an encoder section and a decoder section. The encoder section receives a speech signal in digitized form, such as PCM (pulse code modulation) samples, calculates speech parameters (compressed form of speech) and transmits those parameters on a communication channel. The decoder section receives the compressed form speech parameters and then synthesizes the speech signal. In a specific example, the synthesis operation produces PCM samples. The purpose of the decoder section, therefore, is to effect a transformation that is the reverse of the encoding operation, namely transforming compressed speech frames into an uncompressed speech signal.

The main advantage of compressing speech is that it uses less of the limited channel bandwidth for transmission. The main disadvantage is a reduction in speech quality.

The rapid growth in the diversity of networks and the number of users of such networks is increasing the number of instances where two vocoders are placed in tandem to serve a single connection. Tandem connections of low bit-rate vocoders are known to cause additional distortions and reduce the quality of the speech signal. One example of such a scenario in a wireless context is a wireless-to-wireless link.

In such a case, a first encoder section is used to compress the speech signal generated by the first wireless user. The compressed speech frames generated by the encoder section are transmitted to a base station serving the local wireless terminal and they are then decompressed (converted to PCM format samples) by the decoder section of the local vocoder. The resulting PCM samples arrive at the remote base station serving the second wireless terminal, over the digital trunk of the telephone network. At the remote base station, the PCM samples are compressed by the encoder section of the local vocoder. The compressed speech signal is then transmitted to the second wireless terminal. A the decoder section at the second wireless terminal decompresses the received compressed speech frames to synthesize the original speech signal from the first wireless terminal.

This method of transmitting the speech signals introduces degradation in the speech quality. This is due to the successive compression/decompression cycles of the signal. A possible solution to this problem is to bypass the decoder section of the first base station and the encoder section of the second base station. With this arrangement, compressed speech frames are directly transmitted from one wireless terminal to the other wireless terminal, rather than being converted to PCM samples and transmitted in PCM form through the PSTN network. However, this solution is only feasible when the two mobile terminals, hence the base stations serving them, employ identical vocoders. If the two terminals involved in a connection utilize different vocoders, it is no longer feasible to bypass the intermediate decompression/compression stages. The "bypass" approach is described in the international application serial number PCT/CA95/00704 dated Dec. 13, 1995. The contents of this disclosure are incorporated herein by reference.

Another possible solution is to equip each wireless terminal with a plurality of encoders and decoders selectively used in dependence of the encoders and decoders provided at the remote wireless terminal. At call set-up time, through a combination of in-band and out-of-band signaling and a negotiation protocol, the most suitable common encoders and decoders are selected by each terminal. Unfortunately, this solution may not always be practical since the provisioning of a number of encoders and decoders implies higher costs. In effect, the complexity, and therefore the cost, of encoders is relatively higher than the cost of decoders. This solution hence requires the use of very powerful digital signal processing devices and consumes a great amount of memory capacity.

Thus, there exists a need in the industry for a device and a method capable of improving the voice quality during connections that may include tandemed vocoders, that can be implemented at a relatively low cost.

OBJECTIVES AND SUMMARY OF THE INVENTION

An object of the invention is to provide a novel vocoder that is capable of processing compressed speech frames in a variety of formats.

Another object of the invention is to provide a method for reducing audio signal degradation when an audio signal is transmitted between two communication terminals.

As embodied and broadly described herein, the invention provides a vocoder for processing audio signals, comprising:

- a first input for receiving an audio signal;
- a second input for receiving compressed audio signal frames;
- an encoding section including at least one encoder unit, said encoder unit being coupled to said first input for receiving the audio signal and generating a succession of compressed audio signal frames;
- a decoding section including:
  - a) a group of decoding units, each decoding unit being capable of receiving compressed audio signal frames and generating an audio signal;
  - b) a switch capable of acquiring a plurality of decoder unit selection positions, in each decoder unit selection position said switch directing the compressed audio signal frames received at said second input to a selected one of said decoder units of said decoding section.

In this specification, the term "wireless terminal" is intended to include both mobile terminals and fixed wireless terminals. The term "wireless terminal" is part of a larger family of terminals referred to herein as "speech compression terminals". Speech compression terminals comprise vocoders that are capable of converting speech from a digitized format to a compressed format and vice versa. Other examples of speech compression terminals are those used for Internet telecommunications, Integrated Services Digital Network (ISDN) telecommunications, etc.

The expression "audio signal frame" or "audio data frame" will refer to a group of bits organized in a certain structure that conveys some audio information for a segment of a predefined length. Typically, an audio signal frame when representing a segment of audio signal in compressed form will include a coefficients segment and an excitation segment. The audio signal frame may also include additional elements that may be necessary for the intended application.

The expressions "first format", "second format", etc. when used to describe the audio signal in compressed form in the format of the encoder section of a given vocoder, refers to signals in compressed form that are, generally speaking, not compatible with each other, although they may share a common basic structure. For example, such signals may be divided into a coefficient segment and an excitation segment. Thus, a vocoder operating with signals under the first format will not, generally speaking, be capable of processing signals expressed under any other format than the first format.

In a most preferred embodiment, the vocoder in accordance with the present invention is provided with an encoder section having a single encoder unit while the decoder section has a plurality of decoder units. This asymmetric vocoder configuration manifests a higher compatibility with other type of vocoders while being relatively unexpensive. The majority of the speech compression/decompression algorithms that are in use in wireless and Internet telephony applications have the property that the speech decompression part of the algorithm requires far less computational complexity than the respective speech compression part. Therefore, a low-cost speech compression terminal can be produced which supports a decoder section having a plurality of decoding units that can process compressed audio frames of different formats.

This solution requires a less powerful digital signal processing device than the previously proposed solutions both in terms of the processing capability and memory. This approach will also allow the extension of the life of existing speech compression terminals; that is, these speech compression terminals, equipped with slower digital signal processors, can be retrofitted by merely updating their Read Only Memory (ROM) containing the processor instructions implementing the compression/decompression algorithm.

By providing the decoding section of the vocoder with a plurality of decoder units, each unit capable of processing a different format of compressed audio signal frames, the vocoder can decompress all audio signal frames in a format other than the format of its encoder section. This feature is particularly useful in speech compression communication terminals, such as a wireless terminal, where a variety of speech encoding/decoding formats exist. Theoretically, the present invention allows to develop a speech compression terminal that could be fully compatible with every terminal existing today by providing the decoder section of the vocoder with a decoder unit for each available compressed audio data frame format.

The selection of the decoder unit to be used during the operation of the vocoder can be made in different ways. One possibility, which is particularly suitable for use in wireless terminals, is to rely on a control signal issued by the base station. Each base station communicates with its associated wireless terminal to instruct the terminal to activate a specific decoder unit of the decoder section. The instructions are communicated through any suitable control signal that is received by the decoder unit switch. When the switch receives the signal it activates the designated decoder unit so the communication can take place. If the speech encoder of one terminal has a matching decoder in the other, that decoder is invoked, eliminating the need for decompression and compression of speech in the base stations for the given direction of transmission.

Exchange of voice data then begins and the base stations enter a handshaking procedure with one another to determine if compressed audio signal frames issued by the other terminal are of the same format. In the affirmative, the base stations proceed to establish the bypass mode, where their vocoders are placed off-line, such that the compressed audio signal frames of each terminal are transported through both base stations without encoding/decoding. Decoding occurs only at the communication terminals.

Another possibility is to allow the base stations and the wireless terminals to operate independently from one another. This variant requires the wireless terminal to have the capability of recognizing the incoming compressed audio data frames so as to determine their format and issue accordingly a control signal to the decoder unit switch so the appropriate decoder unit can be enabled. In a specific example, each compressed audio data frame may be provided with a field containing a combination of bits designating the encoder format that has been used to generate the frame. A wireless terminal receiving the frame can read this tag and dynamically set the decoder unit switch to the appropriate position. In this case, each base stations involved in the call also reads this field and proceeds to establish the bypass mode if the bit combination indicated designates a format that is supported by the wireless terminal associated with the base station.

The present invention also allows the establishment of asymmetric communication which is an advantage particularly in circumstances where asymmetry exists in the transmission medium. One example is the case of a wireless transmission where the channel characteristics in the forward and reverse directions may be different. If, for example, the forward link suffers from higher levels of interference compared to the reverse link, it is possible to select in the forward link an encoder unit/decoder unit pair operating at a lower bit-rate, thereby allowing the allocation of a higher bandwidth to the forward channel vocoder. This will allow an increase in the power of forward error correction in the forward link. Note that in this scenario, the encoder section of each vocoder has more than one encoder unit so as to allow an encoding format selection to be made.

Another example is the case of Internet telephony, where congestion in a given direction may necessitate the selection of a lower bit-rate encoder unit in that direction, in order to trade-off speech quality for a lower rate of packet loss.

Yet another example is when voice and data are simultaneously transferred. In this case a lower bit-rate encoder unit may be advantageously used in one direction for the duration of data transfer.

As embodied and broadly described herein, the invention also provides a method for processing audio information, said method comprising the steps of:

receiving at a first input an audio signal;

processing said audio signal by an encoder section to generate a succession of compressed audio data frames;

providing a decoder section having a plurality of decoder units, each decoder unit being capable of receiving compressed audio signal frames and generating an audio signal;

providing a switch capable of acquiring a plurality of decoder unit selection positions, in each decoder unit selection position said switch directing data containing audio information to a selected one of said decoder units;

receiving a control signal indicative of a decoder unit to be enabled for processing incoming compressed audio signal frames;

setting said switch at a position in accordance with said control signal.

As embodied and broadly described herein, the invention further provides a method for configuring two compressed speech communication terminals for permitting establishment of a call session between the communication terminals, each compressed speech communication terminal comprising a vocoder that includes:

an encoder section for generating compressed audio data frames;

a decoder section, said decoder section including a plurality of decoder units;

said method comprising the step of enabling a selected decoder unit in each communication terminal that supports the compressed audio data frames generated by the encoder section of the other communication terminal.

As embodied and broadly described herein, the invention further provides a base station for use in a communication network, said base station being capable of supporting a call session involving a wireless terminal that exchanges data with said base station through an air interface, said base station including:

an encoder section for receiving an audio signal and for generating compressed audio data frames for transmission to the wireless terminal over the air interface, said encoder section being capable of selectively acquiring an operative mode and a bypass mode, in said operative mode an audio signal input to said base station being processed by said encoder section to generate a succession of compressed audio data frames, in said bypass mode said encoder section being disabled whereby data input to said base station being transmitted without processing by said encoder section to the wireless terminal over said air interface;

a control module capable of recognizing signaling information indicative of an encoder format used to generate compressed audio data frames forwarded to said base station from a source other than the wireless terminal, said control module being responsive to said signaling information for:

a) causing said encoder section to proceed to establish said bypass mode;

b) enabling issuance of a control signal over the air interface toward the wireless terminal instructing the terminal to activate a decoder unit compatible with the encoder format indicated in the signaling information.

DESCRIPTION OF A PREFERRED EMBODIMENT

Figure 1:
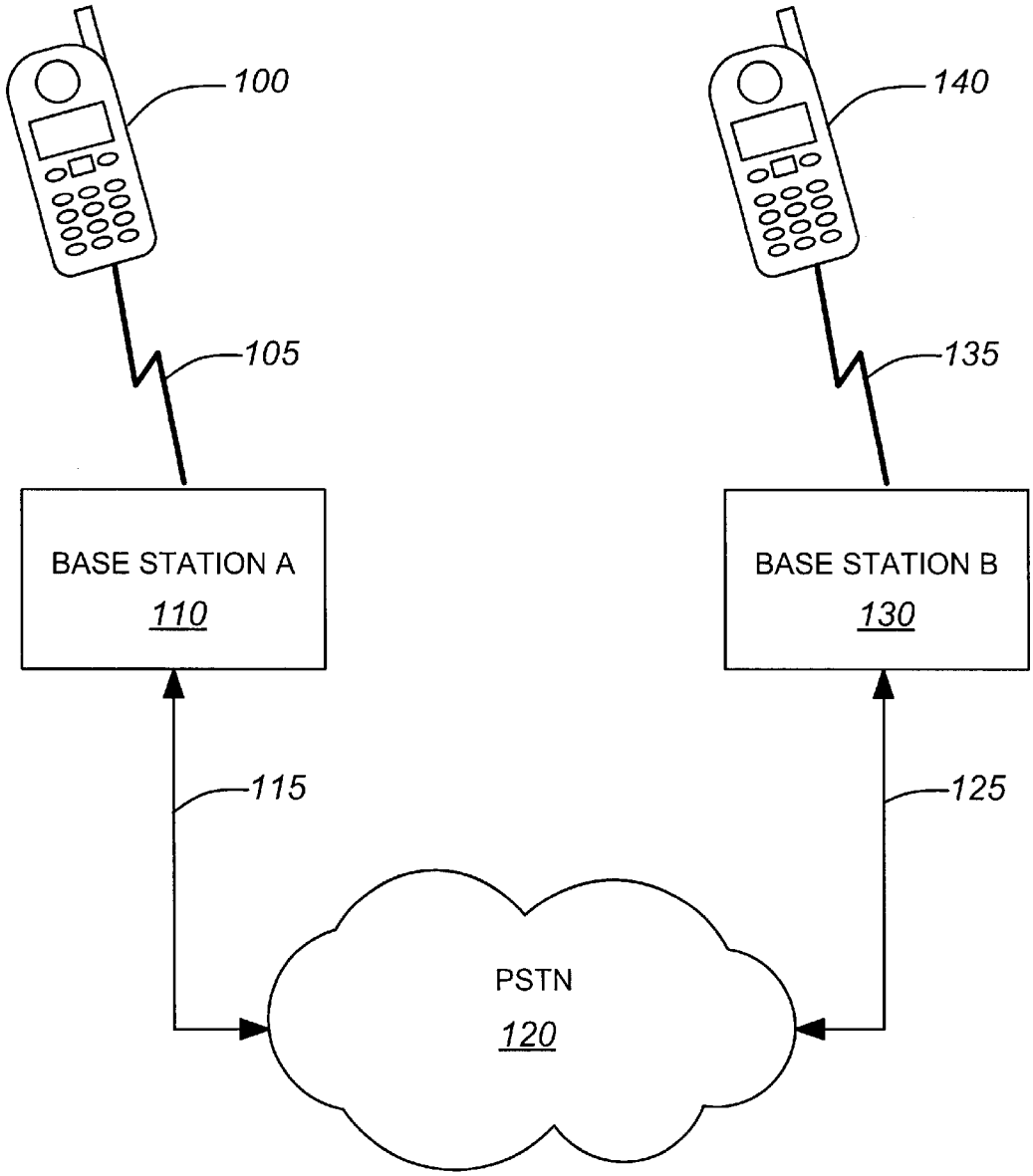
(PRIOR ART) FIG. 1
FIG. 1 is a block diagram providing a simplified illustration of a wireless telecommunication network.

FIG. 1 is a block diagram providing a simplified view of a wireless telecommunications network. FIG. 1 shows a wireless terminal 100 communicating over a wireless link 105 (through an air interface) to a Base Station A (BS A) 110. Wireless link 105 is used to transfer voice data as well as signal and control data. This involves several channels as will be described in detail later. BS A 110 communicates with BS B 140 through the PSTN 120 via physical links 115 and 135 which carry voice data as well as signal and control data. Finally, BS B communicates with wireless terminal 140 over wireless link 135, which is identical to wireless link 105 in this particular embodiment of the invention.

When a call is made to or from a wireless terminal 100 or 140, four radio channels are involved in each of the links 105 and 135 between wireless terminals 100 and 140 and their respective base stations 110 and 130. The channel used to communicate voice data from the BC to the wireless terminal is called Forward Voice Channel (FVC). The channel used to communicate voice data from the wireless terminal to the BS is called the Reverse Voice Channel (RVC). Two other channels carry the handshaking information required to establish communications with wireless terminals. They are the Forward Control Channel (FCC) and the Reverse Control Channel (RCC). Among other things, the FCC and RCC are used to broadcast the Mobile Identification Number (MIN) and the wireless terminal's capabilities. These capabilities would include, for example, the transmission power, the available encoders and decoders, etc. The FCC and the RCC are example of out-of-band communication means for signal and control data. An alternative method of communicating signal and control data would be in-band signaling and involves sending the control information on reserved bits in a compressed audio data frame. This process consists of utilizing certain bits from certain speech samples to transmit signaling information. The location of the signaling bits and the bit robbing rate are selected to reduce the perceptual effect of the bit substitution, such that the audible signal is not significantly affected. The receiver of the compressed audio data frames (either the base station or the wireless terminal, depending upon the direction of the transmission) knows the location of the signaling bits in the compressed audio data frames and it is thus capable of decoding the message.

Figure 2:
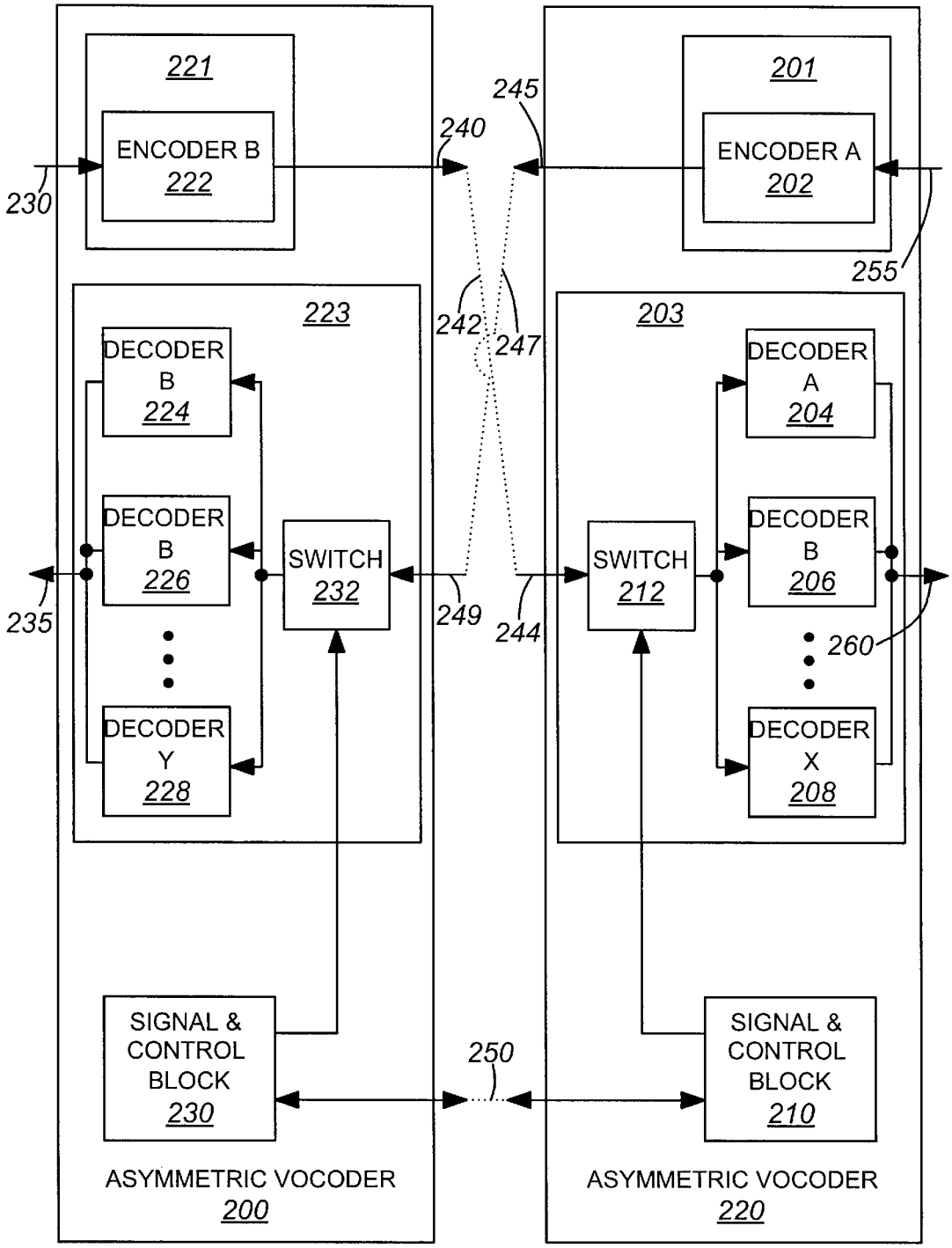
FIG. 2 is a block diagram showing two asymmetric vocoders in accordance with an embodiment of the invention, and which are part of compressed speech terminals engaged in a call session.

FIG. 2 is a block diagram showing two asymmetric vocoders in accordance with an embodiment of the invention. Two similar asymmetric vocoders 200 and 220 are shown. For the purpose of this example, assume that each vocoder resides in a wireless terminal. The remaining components of the wireless terminals have not been shown because they are not necessary in the context of this description. The vocoders have the same components except that the encoder unit and decoder unit formats may vary. In order to avoid redundancy, only one of the vocoders will be described in detail here.

The asymmetric vocoder 200 has an encoder section 221. The encoder section is comprised of a single encoder unit 222 of format A. The encoder section 221 includes an input 230 that receives an audio signal, say in PCM format, and converts that signal into a succession of compressed audio data frames of format A that are issued from output 240. The vocoder also includes a decoder section 223 that includes a group of decoder units 224, 226 and 228 of various formats. The purpose of the decoder section is to perform the reverse transformation that is, convert compressed audio data frames received at input 249 to an audio signal such as expressed in PCM format, an output 235. The actual decoding operation is effected by a decoder unit of the group of decoder units that supports the format of the compressed audio data frames received at the input 249. A switch functional block 232, selects the actual decoder unit to be activated to perform the decoding operation of the particular format of compressed audio data frames received at the input 249.

A signal and control functional block 230 is provided to issue a command signal to the switch 232 to adopt a particular decoder unit selection position. The signal and control functional block 230 is designed to perform a high level function and would normally be shared with other components of the wireless terminal. In other words, the signal and control functional block 230 will not be dedicated to the vocoder but could service the entire wireless terminal. One function that the signal and control functional block 230 performs that is related to the operation of the vocoder 200 is the determination of the position the switch 232 should take based on the format of the compressed audio data frames received at the input 249. Two different possibilities exist in this regard.

Under the first possibility, the format may be explicitly communicated to the signal and control functional block 230, either by using out-of-band signaling or in-band signaling. Such explicit communication can originate from any node in the communication network that is capable of remotely configuring the vocoder 200 during call set-up. In a specific example, the base station that supports the wireless terminal will direct the latter to activate a specific one of the decoder units. The base station issues the appropriate control signal explicitly stating the decoder unit to be enabled. The control signal is directed to the signal and control functional block 230 that uses this control signal to set the switch 232 to the appropriate position.

Under a second possibility, the configuration of the vocoder 200 is effected locally without the need of receiving an external command. The local configuration operation involves recognizing the specific format of the compressed audio data frames that arrive at the input 249 and activate the corresponding decoder unit. In a specific example, this can be made by observing each compressed audio data frame (or alternatively one frame in a group of frames) to determine its format. This involves looking for a characteristic information that conveys the particular format of the frame. One possibility is to look for a combination of bits in a field of the frame that signals the particular format of the frame. Once the frame format has been determined, the signal and control functional block 230 will issue a control signal to the switch to 232 so the latter can adopt the appropriate position and enable the decoder unit that is compatible with the frame's format.

The links 242 and 247 carry voice signals and are dotted lines to illustrate that many links and many network components of various types may be involved. The same applies for the signal and control link 250. In this particular embodiment link 250 is an example of an out-of-band communication means for signal and control data.

Figure 5:
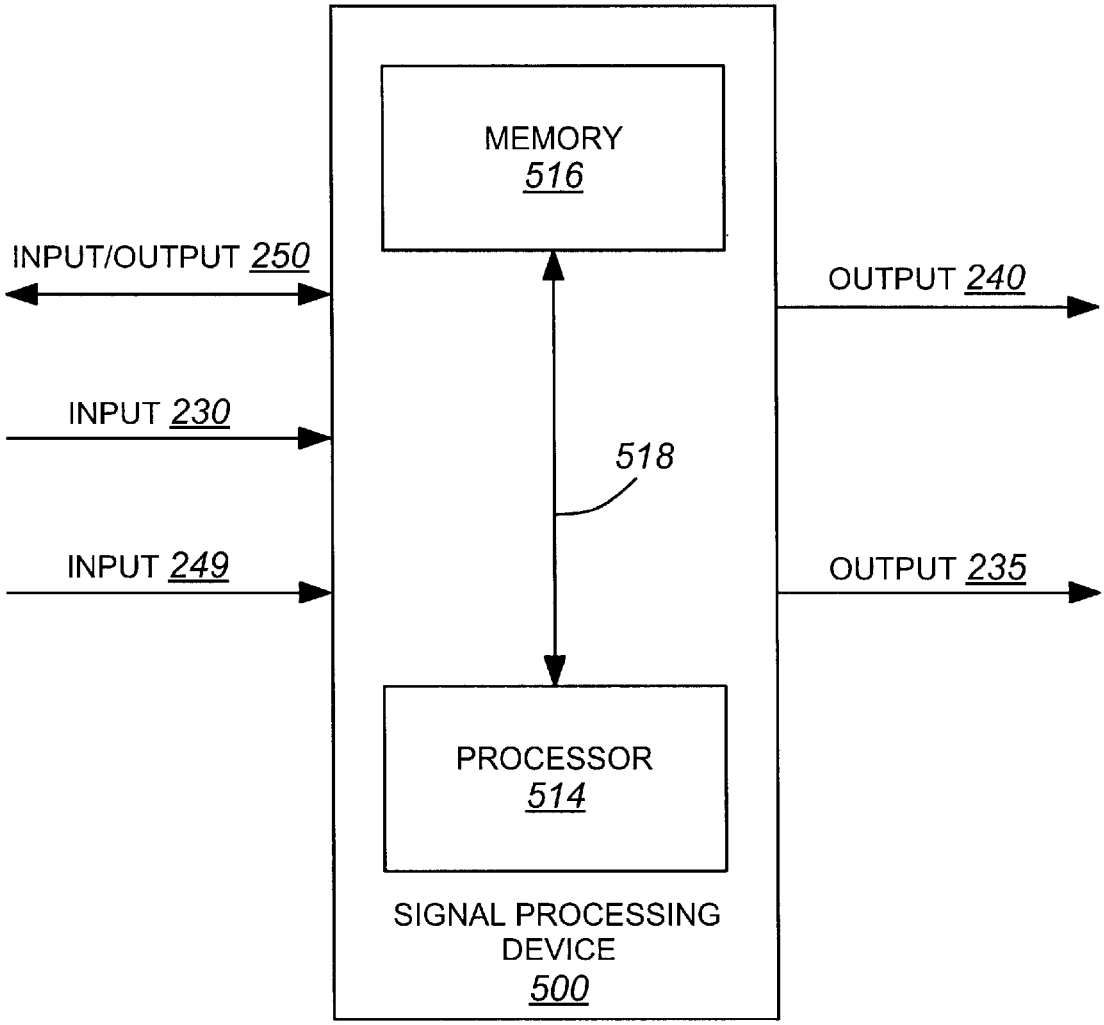
FIG. 5 is a block diagram of a signal processing device built in accordance with an embodiment of the invention and that can be used to implement the function of the vocoders described in FIG. 2.

The apparatus illustrated at FIG. 5 can be used to implement the function of the vocoder 200 whose operation is detailed above in connection with FIG. 2. The apparatus comprises input signal lines 230 and 249, signal output lines 240 and 235, a signal input/output line 250, a processor 514 and a memory 516. The memory 516 is used for storing instructions for the operation of the processor 514 and also for storing the data used by the processor 514 in executing those instruction. A bus 518 is provided for the exchange of information between the memory 516 and the processor 514. The instructions stored in the memory 516 allow the apparatus to implement the functional blocks depicted in the diagram at FIG. 2. Those functional blocks can be viewed as individual program elements or modules that process the data at one of the inputs and issue processed data at the appropriate output.

Under this mode of construction, the encoder unit and the decoder units are actually program elements that are invoked when an encoding/decoding operation is to be performed. The switch functional block 232 is the portion of the overall program that controls which program element corresponding to a particular decoder unit is to be utilized during a given call session.

Other forms of implementation are possible. The encoder unit and the encoder units may be formed by individual circuits, such as microcircuits on a chip. The switch 232 can be any sort of mechanism that can selectively direct the signal to be processed to the appropriate circuit.

Figure 3:
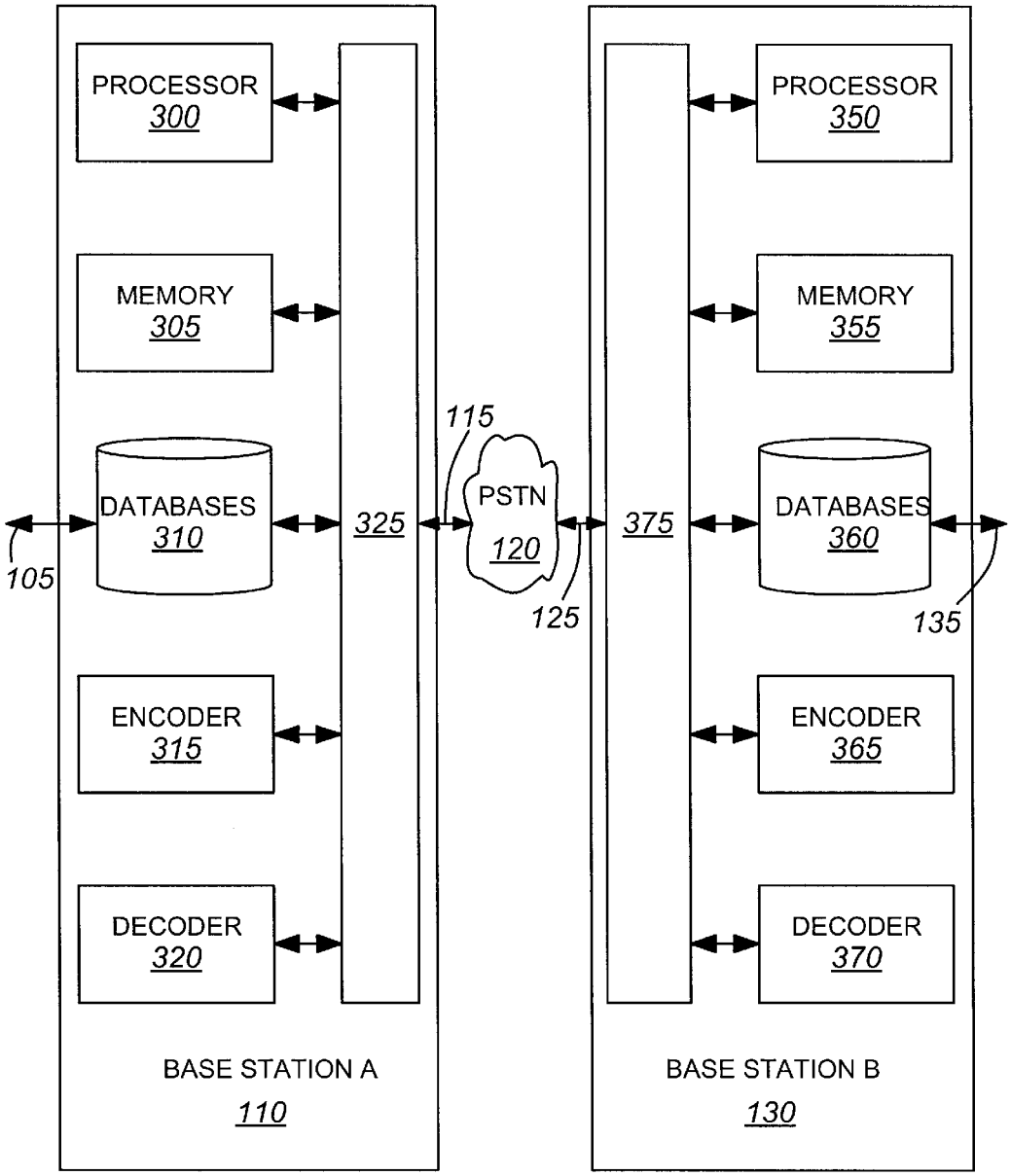
FIG. 3 is a block diagram showing two base stations in accordance with an embodiment of the invention.

FIG. 3 is a block diagram showing two base stations (BS) in accordance with a preferred embodiment of the invention. BS A 110 and BS B 130 shown here are identical. In order to avoid redundancy, only BS A will be described in detail here.

BS A 110 has a processor 300, a memory 305, various databases 310 containing information necessary for the operation of the base station, a encoder unit 315, a decoder unit 320 and a data bus 325. In the example shown, the encoder unit 315 and the decoder unit 320 are shown as separate components that can be in the form of micro circuits realized on a chip. This form of implementation is shown merely as a possible example and not with the intent to limit the scope of the invention to this particular configuration. The encoder unit and the decoder unit can also be realized through software that is executed by the processor 300. The processor 300 executes the programs stored in memory 305 and is responsible for controlling all information entering or leaving the base station 110 as well as controlling all information circulating inside BS A 110 on data bus 325. In addition to storing programs, the memory 305 may act as a buffer for storing data temporarily. The databases 310 may hold information regarding the terminal capabilities or data of the same type.

The encoder unit 315 will convert speech from PCM format to compressed form. The decoder 320 converts compressed speech to PCM format. As stated before, the inputs and outputs to BS A 110 may be a wireless link 105 to a wireless terminal 100 and a second link 115 to the PSTN 120.

Figure 4:
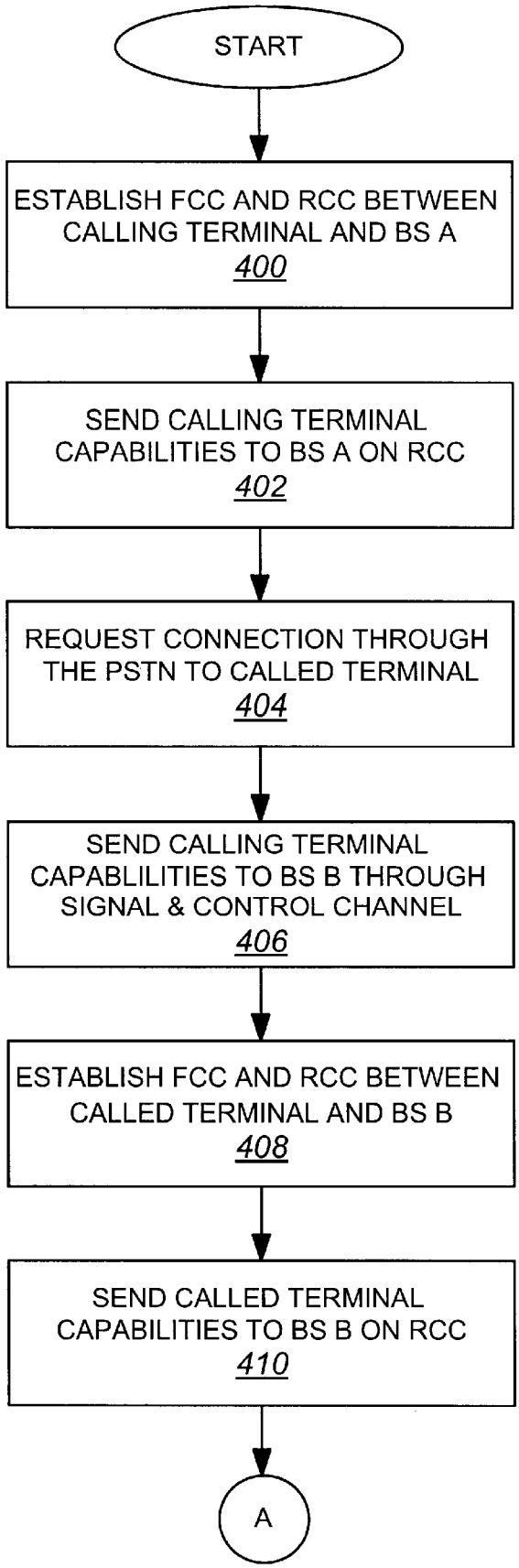
FIG. 4 is a flowchart of a method for effecting decoder unit selection, during a communication between two compressed speech terminal, in accordance with an embodiment of the invention.
Figure 4:
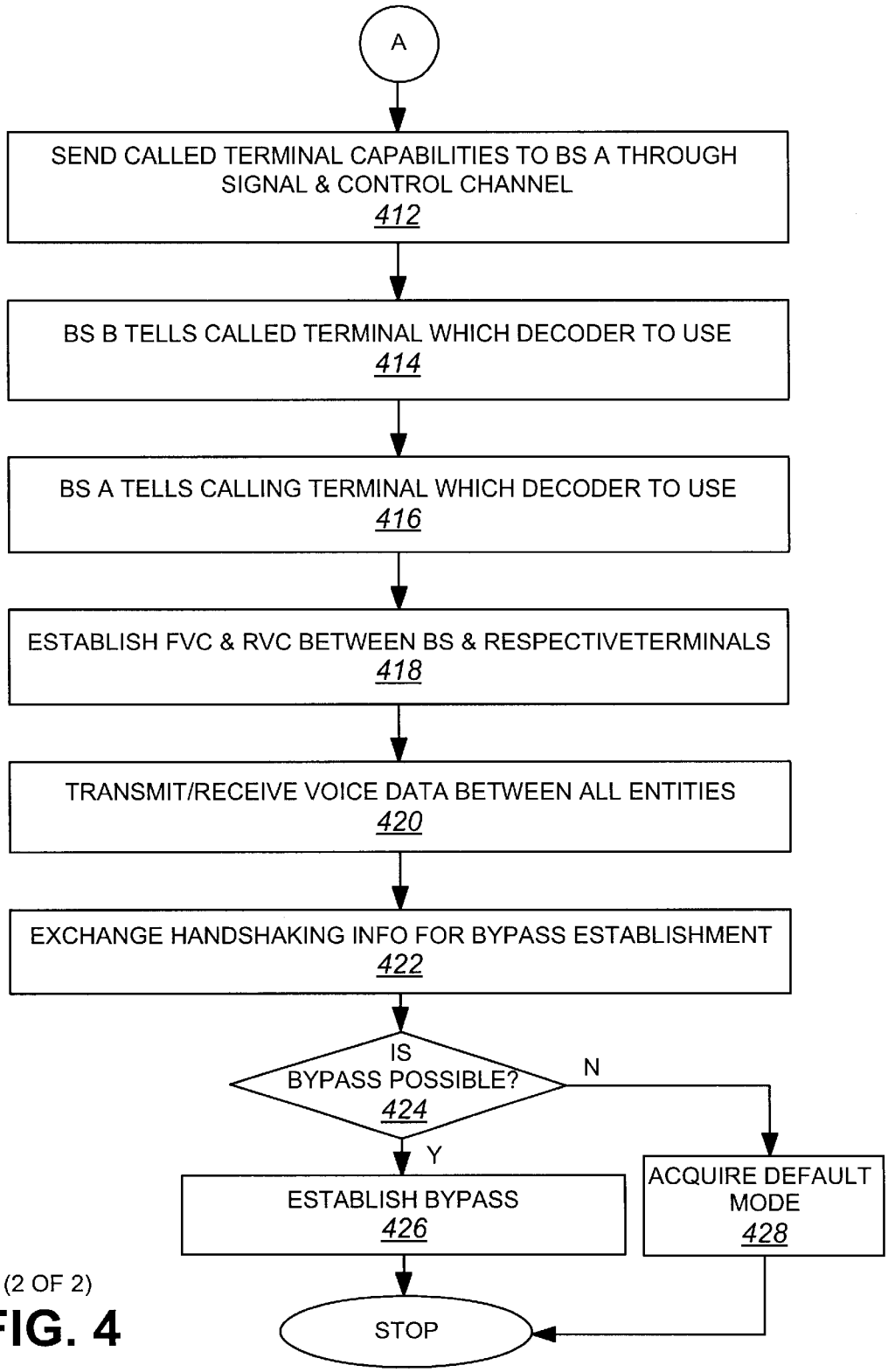

FIG. 4 is a flowchart of a method for establishing decoder unit selection, during a communication between two terminals, in accordance with an embodiment of the invention. In this example, the wireless terminal 100 requests establishment of a call session with wireless terminal 140. At step 400, the procedure is initiated by establishing the FCC and the RCC between the calling terminal 100 and BS A 110 as described earlier. At step 402, data is sent on the RCC from a wireless terminal 100 to inform BS A 110 of, among other things, the capabilities of the calling terminal 100, the calling number and the called number. The calling terminal 100 capabilities may include the list of encoder units and decoder units available.

The information sent from the wireless terminal 100 to the base station 110 regarding the capabilities of the wireless terminal may be explicit or non explicit. The explicit form of communication involves sending on a control channel the list of all the encoder and decoder units available in the terminal or it may involve simply sending the formats that are being supported by this terminal. Thus, the wireless terminal may send a string of bits that designate the format in which speech is encoded and also the list of the formats that can be handled by the decoder section. The non explicit form of communication involves sending a unique code that can be used by the base station 110 to determine the capabilities of the wireless terminal. This form of a construction may involve the transmission of fewer bits. A further requirement is a look up table in the memory of the base station 110 that contains the list of all of the possible wireless terminal identification codes and each code is associated with the encoding and decoding formats that are supported by that particular wireless terminal. When a wireless terminal sends to the base station its identification code, the base station consults the look up table and determines what are the exact capabilities of that terminal. That information can then be used by the base station to determine whether data packets in compressed form that are received from the base station associated with the called wireless terminal can be sent directly to the calling wireless terminal. This will be discussed in greater detail later.

BS A 110 then requests a connection to the called terminal 140 through the PSTN 120 (step 404). The request for connection involves sending information regarding the capabilities of the the calling terminal 100. This information may be sent either over the signaling network of the PSTN or through in-band signaling by using the bit stealing protocol mentioned earlier. At step 406, the calling terminal 100 capabilities are thus communicated to BS B 130. At step 408, the FCC and RCC are established between the called terminal 140 and BS B 130. The called terminal 140 capabilities are then communicated to BS B on RCC (step 410). This is effected in a manner similar to the process described in connection with wireless terminal 100 and its associated base station 110. At this point BS B 130 is aware of the capabilities of both terminals involved in the communication link.

The next step of the process is to communicate to BS A 110 what are the capabilities of the called terminal 140. This is effected (step 412) by constructing a message at BS B 130 that contains the relevant information and that is sent to BS A 110. In a specific example, this message can take the form of an acknowledgement message where BS B 130 advises BS A 110 that the original message (step 406) has been properly received. At this point, both BS A 110 and BS B 130 have the required information to determine the best encoder/decoder combination in each of the terminals 100 and 140 in order to obtain acceptable speech quality. The following specific example will illustrate the process in greater detail. Assume that the calling terminal 100 has an encoder unit of the format A, and has a decoder section provided with four decoder units, there being a decoder unit for format A, a decoder unit for format B, a decoder unit for format C and a decoder unit for format D. As to the called terminal, (140) it has an encoder unit of the format D, and has a decoder section provided with four decoder units, there being a decoder unit for format A, a decoder unit for format B, a decoder unit for format C and a decoder unit for format D. The action that each base station takes can be determined through logic principles with the aid of a simple look-up table. The principles are the following ones:

A) If the remote wireless terminal has a decoder unit of a format supporting the format of the encoder unit for the local wireless terminal, then the decoder section of the base station proceeds to establish the bypass mode, thus the compressed audio signal frames received from the local wireless terminal are transmitted without decoding to the base station supporting the remote wireless terminal;

B) If the local wireless terminal has a decoder unit that can support the encoder format of the remote terminal then the encoder unit of the local base station proceeds to establish the bypass mode, whereby compressed audio frames transmitted from the remote wireless terminal are simply re-transmitted to the local wireless terminal without re-encoding, and the base station signals the local wireless terminal to activate the appropriate decoder unit.

Note that steps A and B of this process do not need to be executed simultaneously such that compressed audio data frames generated by the calling wireless terminal 100 are transmitted throughout the entire communication path, including both base stations without decoding. At the same time, data traveling on the reverse direction may be processed differently. For instance, if the calling wireless terminal 100 does not possess a decoder unit that supports the format of the encoder unit of the called wireless terminal 140, the base stations then process data from the called terminal to the calling terminal in the default mode where compressed audio data frames received at BS B 130 are decoded into PCM samples, the PCM samples transmitted over the communication network to the BS A 110 and there they are encoded into a format that is supported by the decoder unit of the calling terminal 100. The compressed audio data frames are then sent over the wireless link to the calling wireless terminal 100. This mode of communication avoids vocoder tandeming only on one side of the communication path which, objectively is not optimal, however, it demonstrates the flexibility of the system and the usefulness of the asymetry of the vocoder.

For the actual decision making process a lookup table could be used, as mentioned earlier. Such lookup table can be constructed to map the capabilities of the terminals involved in the call session to a set of actions to be taken by a base station. The following is a possible representation of such a look up table.

| | | COMMUNICATION TERMINAL TYPE | | |
|---|---|---|---|---|
| | | 0 | 1 | 2 |
| COMMUNICATION TERMINAL TYPE | 0 | Action set 0 | Action set 1 | Action set 2 |
| | 1 | Action set 3 | Action set 4 | Action set 5 |
| | 2 | Action set 6 | Action set 7 | Action set 8 |

In the above table the communication terminal type is a code that uniquely identifies the capabilities of the wireless terminal. For instance, the codes may mean the following:

| WIRELESS TERMINAL CODE | ENCODER UNIT FORMAT | DECODER UNIT FORMATS |
|---|---|---|
| 0 | Format A | Formats A, B, C, D, E and F |

-continued

| WIRELESS TERMINAL CODE | ENCODER UNIT FORMAT | DECODER UNIT FORMATS |
|---|---|---|
| 1 | Format B | Formats A, B, C, D, E and F |
| 2 | Format C | Formats A, B, C, D, E and F |

Thus, taking the example of BS A 110, when the calling wireless terminal has been determined to be of type 0 and the called wireless terminal to be of type 0 then the action set 0 is taken by the base station. The action set 0 implies the following:

1) Start handshaking procedure toward setting the encoder unit and the decoder unit of the base station to the bypass mode;
2) Issue a signal to the calling wireless terminal 100 to activate the decoder unit corresponding to format A.

The other action sets do not need to be described because they can be easily derived from the above description.

Referring back to FIG. 4 the steps 414–428 summarize the process for configuring the base stations and the wireless terminals, as described above. More specifically, now that both BS A 110 and BS B 130 know the capabilities of terminals 100 and 140, they can instruct their respective terminals to select a specific decoder (steps 414 and 416). At step 418, a Forward Voice Channel (FVC) and a Reverse Voice Channel (RVC) are established between the base stations and their respective terminals. At step 420, voice data is exchanged between all entities.

At steps 422 and 424, BS A 110 and BS B 130 begin the handshaking process to determine if bypass establishment is possible. If it is, the processor 350 will bypass the decoder 370 and encoder 365 of BS B 130 and the processor 300 will bypass the encoder 315 and the decoder 320 of BS A 110 (step 426). If bypass is not possible, the base stations acquire the default mode (step 428) where each base station encodes/decodes the compressed audio signal frames without any bypass.

The above description of a preferred embodiment of the present invention should not be read in a limitative manner as refinements and variations are possible without departing from the spirit of the invention. The scope of the invention is defined in the appended claims and their equivalents.

We claim:

1. A vocoder for processing audio signals, comprising:

a first input for receiving an audio signal;

a second input for receiving compressed audio signal frames;

an encoding section including at least one encoder unit, said encoder unit being coupled to said first input for receiving the audio signal and generating a succession of compressed audio signal frames;

a decoding section including:

a) a group of decoder units, each decoder unit being capable of receiving compressed audio signal frames and generating an audio signal, said vocoder comprising more decoder units than encoder units;

b) a switch capable of acquiring a plurality of decoder unit selection positions, in each decoder unit selection position said switch directing the compressed audio signal frames received at said second input to a selected one of said decoder units of said decoding section.

2. A vocoder as defined in claim 1, wherein the decoder units are capable of processing compressed audio data frames of different formats.

3. A vocoder as defined in claim 2, wherein said vocoder includes a single encoder unit.

4. A vocoder as defined in claim 3, wherein said switch is responsive to a control signal to acquire a selected decoder unit selection position.

5. A compressed speech communication terminal comprising the vocoder defined in claim 1.

6. A method for processing audio information, said method comprising the steps of:

receiving at a first input an audio signal;

processing said audio signal by an encoder section to generate a succession of compressed audio data frames, said encoder section including at least one encoder unit;

providing a decoder section having a plurality of decoder units, each decoder unit being capable of receiving compressed audio signal frames and generating an audio signal, said decoder section including more decoder units than encoder units;

providing a switch capable of acquiring a plurality of decoder unit selection positions, in each decoder unit selection position said switch directing data containing audio information to a selected one of said decoder units;

receiving a control signal indicative of a decode unit to be enabled for processing incoming compressed audio signal frames;

setting said switch at a position in accordance with said control signal.

7. A method as defined in claim 6, wherein said control signal is issued over an air interface.

8. A method as defined in claim 7, wherein said control signal is generated by a base station of a telecommunication network.

9. A method as defined in claim 8, wherein the decoder units are capable of processing compressed audio data frames of different formats.

10. A method for configuring two compressed speech communication terminals for permitting establishment of a call session between the communication terminals, each compressed speech communication terminal comprising a vocoder that includes:

an encoder section for generating compressed audio data frames;

a decoder section, said decoder section including a plurality of decoder units;

at least one of said two compressed speech communication terminals further including a decoder section having more decoder units than encoder units;

said method comprising the step of enabling a selected decoder unit in each communication terminal that supports the compressed audio data frames generated by the encoder section of the other communication terminal.

11. A method as defined in claim 10, wherein each compressed speech communication terminal includes a switch capable of acquiring a plurality of decoder unit selection positions, in each decoder unit selection position said switch directing compressed audio signal frames received from the other compressed speech communication terminal to a selected one of said decoder units of said decoding section, said method comprising the steps of forwarding to the switch of each compressed switch communication terminal a control signal for setting each switch to a selected decoder unit selection position whereby each compressed speech communication terminal is capable of supporting the compressed audio data frames generated by the encoder section of the other compressed speech communication terminal.

12. A method as defined in claim 11, wherein the decoder units are capable of processing compressed audio data frames of different formats.

* * * * *